US010100494B2

(12) United States Patent
Vonderwell et al.

(10) Patent No.: US 10,100,494 B2
(45) Date of Patent: Oct. 16, 2018

(54) CLOSED-LOOP CONTROL OF SWING

(71) Applicant: Caterpillar Inc., Peoria, IL (US)

(72) Inventors: Mark P. Vonderwell, Franklin, WI (US); Douglas W. Seeger, Franksville, WI (US); Christopher A. Williamson, Greendale, WI (US)

(73) Assignee: Caterpillar Inc., Deerfield, IL (US)

( * ) Notice: Subject to any disclaimer, the term of this patent is extended or adjusted under 35 U.S.C. 154(b) by 118 days.

(21) Appl. No.: 15/235,785

(22) Filed: Aug. 12, 2016

(65) Prior Publication Data

US 2018/0044887 A1 Feb. 15, 2018

(51) Int. Cl.

| | |
|---|---|
| ***B66C 23/86*** | (2006.01) |
| ***E02F 9/12*** | (2006.01) |
| ***E02F 9/22*** | (2006.01) |
| ***E02F 9/20*** | (2006.01) |
| ***F15B 11/08*** | (2006.01) |
| ***F15B 21/08*** | (2006.01) |
| *E02F 3/30* | (2006.01) |

(52) U.S. Cl.

CPC ..... *E02F 9/123* (2013.01); *E02F 9/2004* (2013.01); *E02F 9/2296* (2013.01); *F15B 11/08* (2013.01); *F15B 21/08* (2013.01); *E02F 3/308* (2013.01); *F15B 2211/20546* (2013.01); *F15B 2211/75* (2013.01)

(58) Field of Classification Search

CPC ... B66C 23/86; B60K 2006/126; E02F 9/265; E02F 9/2029; E02F 9/2296; E02F 9/2066; E02F 9/2289; E02F 9/2292; E02F 9/2235; E02F 9/123; E02F 9/205; F15B 13/0401; F15B 1/033; F15B 2211/255; F15B 2211/405; F15B 2211/212

USPC ..... 701/50, 36, 99; 37/379; 60/436, 413, 60/442; 702/182, 127, 150, 151; 318/131, 475, 469, 567, 568.18, 568.22, 318/689; 414/680, 685, 697

See application file for complete search history.

(56) References Cited

U.S. PATENT DOCUMENTS

| | | | |
|---|---|---|---|
| 3,999,387 | A | 12/1976 | Knopf |
| 4,475,442 | A | 10/1984 | Breeden |
| 4,559,778 | A | 12/1985 | Krusche |
| 6,520,731 | B2 | 2/2003 | MacLeod |

(Continued)

FOREIGN PATENT DOCUMENTS

| | | |
|---|---|---|
| JP | 04037889 | 6/1992 |
| KR | 1020150117481 | 10/2015 |
| KR | 101643023 | 7/2016 |

*Primary Examiner* — Dalena Tran

(74) *Attorney, Agent, or Firm* — Miller, Matthias & Hull

(57) ABSTRACT

A system and method for controlling the swing of a machine is disclosed. The system may comprise a hydrostatic circuit that includes an electronic displacement control pump and a first swing motor fluidly connected in a closed loop circuit. The electronic displacement control pump configured to control the supply of fluid to the swing motor based on a final pump displacement command. The first swing motor configured to rotate the upper carriage of the machine. The hydrostatic circuit configured to control (a) an actual speed of the first swing motor when the final pump displacement command results from a requested swing motor speed and (b) a torque of the first swing motor when the final pump displacement command results from a requested swing motor torque.

18 Claims, 7 Drawing Sheets

(56) References Cited

U.S. PATENT DOCUMENTS

| | | | | |
|---|---|---|---|---|
| 6,584,710 | B1 * | 7/2003 | Lin | B60G 3/145 172/2 |
| 7,977,182 | B2 | 7/2011 | Nishi et al. | |
| 8,567,186 | B2 | 10/2013 | Hyodo et al. | |
| 8,738,239 | B2 | 5/2014 | Kang et al. | |
| 9,022,749 | B2 | 5/2015 | Akiyama et al. | |
| 9,181,682 | B2 | 11/2015 | Anders et al. | |
| 9,309,645 | B2 | 4/2016 | Yamamoto et al. | |
| 2003/0002972 | A1 | 1/2003 | Macleod | |
| 2011/0029206 | A1 * | 2/2011 | Kang | E02F 9/123 701/50 |
| 2011/0020146 | A1 | 7/2011 | Akiyama et al. | |
| 2012/0101696 | A1 | 4/2012 | Udagawa | |
| 2012/0283919 | A1 * | 11/2012 | Kuras | B60L 11/005 701/50 |
| 2013/0061588 | A1 * | 3/2013 | Jagoda | B60K 6/12 60/414 |

* cited by examiner

CLOSED-LOOP CONTROL OF SWING

TECHNICAL FIELD

The present disclosure generally relates to control processes in machines and, more particularly, relates to processes for use in controlling rotational swing on a machine.

BACKGROUND

Excavators, power shovels and similar earth-moving equipment are typically equipped with a swing drive that rotates the upper carriage (upper machine structure including the working tool) with respect to the undercarriage (lower machine structure with tracks or wheels for propulsion). The swing drive may be powered by hydraulic or electric motors. Swing speed control may be utilized on construction excavators, backhoes and similar machines. That is, when the operator moves a control lever, the position of the lever corresponds to a desired rotational velocity of the swing drive. The operator may adjust the lever command to obtain the desired speed and to compensate for changes in payload, linkage position or other factors that may affect swing speed. Large inertial loads, such as are common with large cranes or mining shovels, may be controlled by swing torque control. Swing torque control means that the operator lever position is interpreted as a desired motor torque, allowing the operator to modulate both the speed and acceleration of the swing drive.

For hydraulically powered swing drives, swing control has historically been accomplished using hydro-mechanical valves in the hydraulic circuit and the swing control characteristics (swing speed control, swing torque control) of such swing drives are primarily determined by the selection and setting of flow and pressure control valves, pump displacement control mechanisms, and other hydromechanical components. In other words, whether a hydraulic swing circuit primarily uses speed or torque control is determined by the hydraulic hardware because such hydraulic swing circuits primarily provide torque control or speed control for the swing motor but do not provide the option to have either torque control or speed control with the same hydraulic circuit.

Due to the size and weight of the upper carriage, there are large inertial forces to be overcome during initial movement. Displacement control pumps are not used to control speed of the swing motor because the swing speed tends to oscillate due to the amount of fluid pressure required to initiate movement, the large compressible volume hoses between the pump and swing motor, and the lack of any significant oscillation damping benefit provided by a work surface (ground, mine wall, etc.) in resistive contact with the upper carriage (the upper carriage swings through the air). Moreover, performance with a displacement control pump may be further decreased if a closed loop hydraulic circuit is utilized.

U.S. Pat. No. 6,520,731 ("MacLeod") issued Feb. 18, 2003 describes a control system for swing cylinders to position a boom on a backhoe. The system includes a pair of double acting hydraulic cylinders on a backhoe frame operatively connected to the boom for swinging the boom with respect to the frame, a pump arranged in a closed circuit with the hydraulic cylinders such that the control of the pump is the sole means of controlling the cylinders. The disclosure does not address controlling bouncing/oscillating between decreasing and increasing signals for fluid volume displacement. A better design is needed.

SUMMARY OF THE DISCLOSURE

In accordance with one aspect of the disclosure, a system for controlling swing of an upper carriage of a machine is disclosed. The system may comprise a hydrostatic circuit, a speed sensor, a first pressure sensor, a second pressure sensor, a user interface and a controller. The hydrostatic circuit includes an electronic displacement control pump, a first swing motor, a first conduit and a second conduit. The electronic displacement control pump is configured to control the supply of a fluid to a first swing motor based on a final pump displacement command. The first swing motor is fluidly connected to the electronic displacement control pump. The first swing motor is configured to rotate the upper carriage of the machine. The first conduit fluidly connects the electronic displacement control pump and the first swing motor. The second conduit fluidly connects the electronic displacement control pump and the first swing motor. The speed sensor is configured to measure an actual speed of the first swing motor. The first pressure sensor is configured to measure an input pressure of the fluid received by the first swing motor. The second pressure sensor is configured to measure an output pressure of the fluid discharged from the first swing motor. The user interface is in operable communication with a controller and is configured to receive and transmit a user input to the controller. The controller is in operable communication with the hydrostatic circuit. The controller is configured to transmit a pump displacement signal representative of the final pump displacement command to the electronic displacement control pump as a result of the user input. The hydrostatic circuit is a closed loop circuit that is configured to control the actual speed of the first swing motor when the user input is associated with a requested swing motor speed and is configured to control a torque of the first swing motor when the user input is associated with a requested swing motor torque.

In accordance with another aspect of the disclosure, a method of controlling the swing of an upper carriage of a machine is disclosed. The machine includes the upper carriage, a lower carriage and a system. The upper carriage is rotationally connected to the lower carriage. The lower carriage includes ground engaging elements. The system includes a controller and a hydrostatic circuit. The hydrostatic circuit is a closed loop circuit. The hydrostatic circuit includes an electronic displacement control pump and a first swing motor fluidly connected to the electronic displacement control pump. The method may comprise: receiving a mode input; placing, by the controller, the system in a speed mode or a torque mode based on the mode input, the system operable in the speed mode when the mode input is speed mode and operable in the torque mode when the mode input is torque mode; receiving, by the controller, a user input, the user input received as a requested swing motor speed if the system is in speed mode or received as a requested swing motor torque if the system is in torque mode; and controlling, by the system, the swing of the upper carriage based on the mode input and the user input.

In accordance with a further aspect of the disclosure, a system for controlling rotational swing of an upper carriage of a machine is disclosed. The system may comprise a hydrostatic circuit. The hydrostatic circuit includes an electronic displacement control pump and a first swing motor. The electronic displacement control pump is configured to receive a pump displacement signal that controls a fluid displacement volume of the electronic displacement control pump, the pump displacement signal representative of a final pump displacement command. The first swing motor is fluidly connected to the electronic displacement control pump and is configured to rotate the upper carriage of the machine. The hydrostatic circuit is a closed loop circuit that is configured to control (a) an actual speed of the first swing motor when the pump displacement command results from a requested swing motor speed and (b) a torque of the first swing motor when the pump displacement command results from a requested swing motor torque.

DETAILED DESCRIPTION

Figure 1:
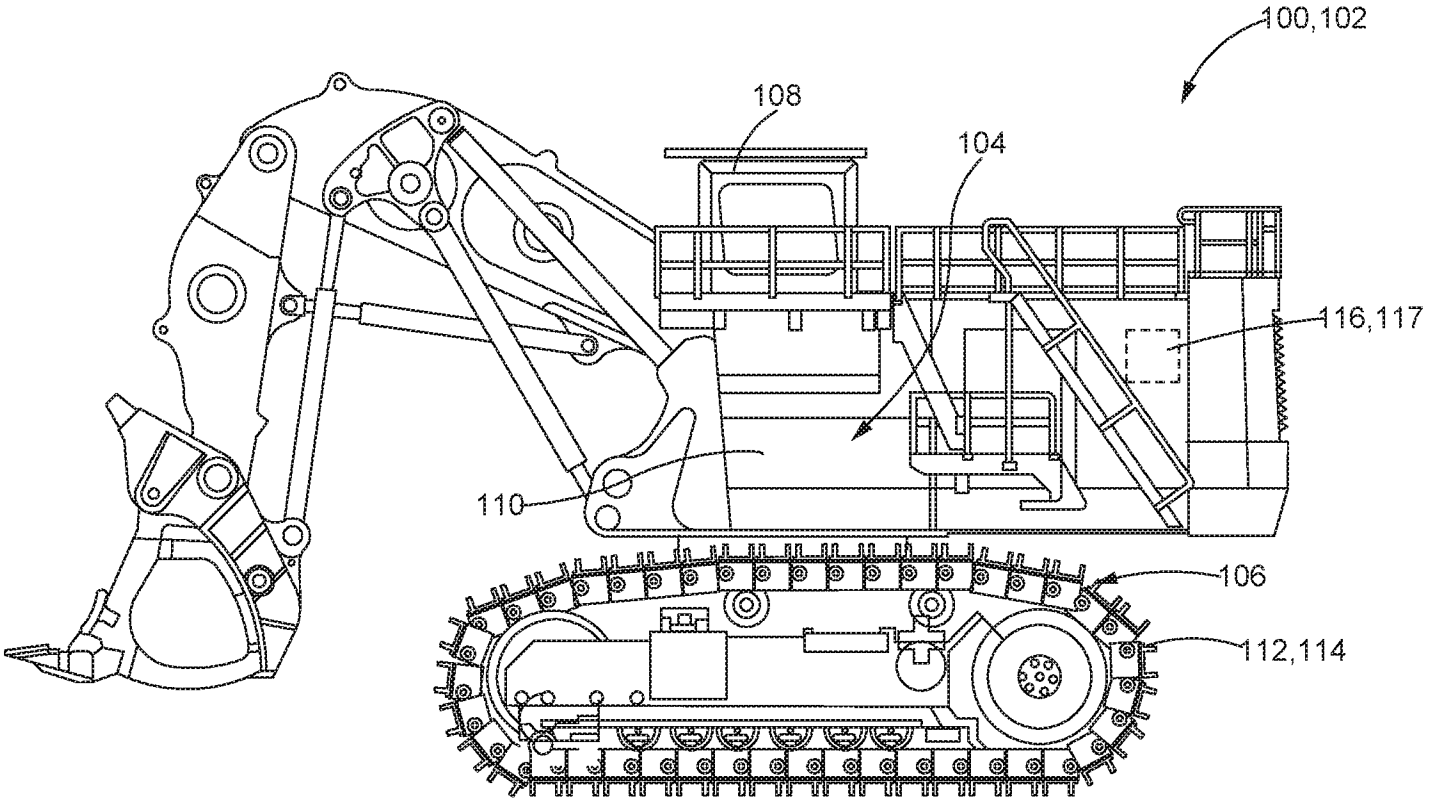
FIG. 1 is a side view of an exemplary machine 100 that includes an upper carriage 104.

FIG. 1 illustrates one example of a machine 100 that incorporates the features of the present disclosure. The exemplary machine 100 may be a vehicle such as an excavator, hydraulic mining shovel or the like. FIG. 1 illustrates an exemplary machine 100 that is a hydraulic mining shovel 102. The machine 100 includes an upper carriage 104 rotationally connected to a lower carriage 106. The upper carriage 104 rotates in both the clockwise and the counterclockwise direction. The upper carriage 104 includes an operator station 108 and a body 110. The lower carriage 106 includes one or more ground engaging units 112. In the exemplary embodiment, the ground engaging units 112 are track assemblies 114. One of ordinary skill in the art will appreciate that the machine 100 further includes a power source 116, for example an engine 117, that provides power to the ground engaging units 112 and a final drive assembly (not shown) via a mechanical or electrical drive train. While the following detailed description and drawings are made with reference to a hydraulic mining shovel 102, the teachings of this disclosure may be employed on similar machines 100 in which an upper carriage 104 swings or rotates (through the air and unobstructed by the ground) relative to a lower carriage 106.

Figure 2:
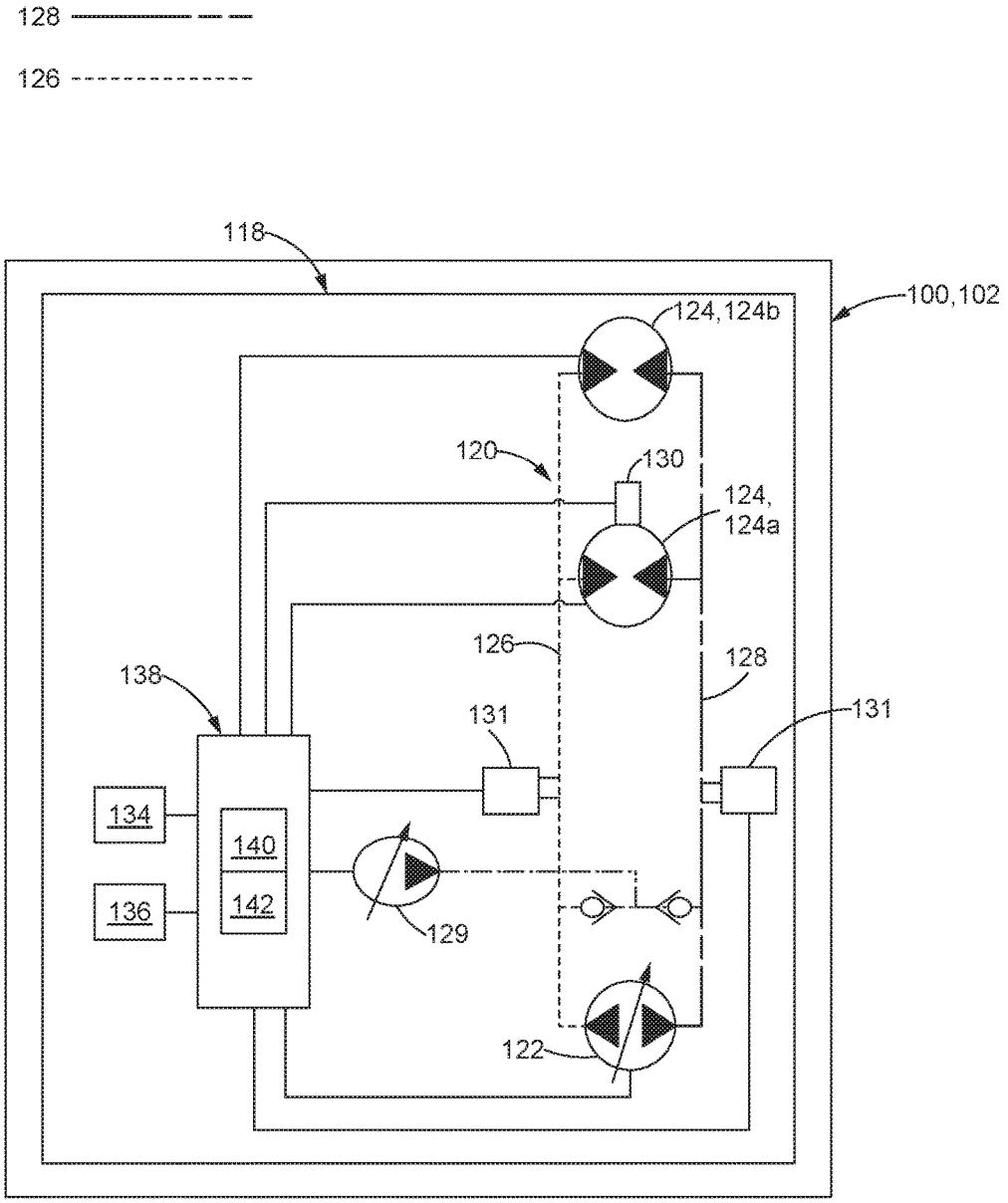
FIG. 2 is a schematic representation of an exemplary system 118 for controlling rotational movement of the upper carriage 104 of the machine 100 of FIG. 1.

As illustrated in FIG. 2, the machine 100 may further include a system 118 for controlling movement (e.g., swing/rotational movement) of the upper carriage 104 of the machine 100 relative to the lower carriage 106 of the machine 100. The system 118 comprises a hydrostatic circuit 120 that includes an electronic displacement control pump 122, one or more swing motors 124, a first conduit 126 and a second conduit 128. The hydrostatic circuit 120 is a closed loop circuit.

The electronic displacement control pump 122 may be, in one embodiment, a variable displacement piston pump whose fluid displacement volume is controlled electronically. The electronic displacement control pump 122 is configured to pump fluid to the one or more swing motors 124 in the closed loop circuit of the hydrostatic circuit 120. As used herein, a closed loop circuit is one in which fluid that is pumped from the electronic displacement control pump 122 to the swing motors 124 is returned to the electronic displacement control pump 122. In such a closed loop circuit, a reservoir is not utilized to hold the returning fluid for subsequent suction by the electronic displacement control pump 122.

Each swing motor 124 is fluidly connected to the electronic displacement control pump 122 and is configured to rotate (rotational swing) the upper carriage 104 of the machine 100 via connecting linkage (e.g., a pinion gear and ring gear arrangement, or the like). In the embodiment illustrated in FIG. 2, the hydrostatic circuit 120 includes a first swing motor **124*a* and a second swing motor 124*b*** connected in parallel.

The first conduit 126 fluidly connects the electronic displacement control pump 122 and the first swing motor **124*a*. Similarly, the first conduit 126 fluidly connects the electronic displacement control pump 122 and the second swing motor 124*b*. The second conduit 128 fluidly connects the electronic displacement control pump 122 and the first and second swing motors 124*a*,124*b*. When the upper carriage 104 swings in the clockwise direction, the swashplate of the electronic displacement control pump 122 actuates in a first direction and the first and second swings motors 124*a*, 124*b* turn in a first direction. When the upper carriage 104 swings in the counterclockwise direction, the swashplate of the electronic displacement control pump 122 actuates in the opposite direction, and the first and second swing motors 124*a*, 124*b* turn the opposite direction too. The direction of fluid flow in the hydrostatic circuit 120 when the upper carriage 104 rotates in the counterclockwise direction is opposite to the direction of fluid flow in the hydrostatic circuit 120 when the upper carriage 104** rotates in the clockwise direction (and the inlet and outlet of the motor are swapped).

The hydrostatic circuit 120 may include one or more charge pumps 129 fluidly connected to the hydrostatic circuit 120 to make up for any fluid losses due to leakage, or the like, that may occur in the closed loop circuit. Such a charge pump 129 is configured to draw fluid from a typically small charge pump reservoir containing "make up" fluid and inject such fluid into the closed loop circuit of the hydrostatic circuit 120.

The system 118 further includes a speed sensor 130 and/or a plurality of pressure sensors 131. The speed sensor 130 is configured to measure an actual speed of one of the swing motors 124, for example, the first swing motor **124*a*. Each pressure sensor 131 is configured to measure fluid pressure in one of the conduits, either the first conduit 126 or the second conduit 128. Depending on the direction of fluid flow in the hydrostatic circuit 120, the fluid pressure measured may be either an input pressure of the fluid received by the first swing motor 124*a*, or an output pressure of the fluid returning from the swing motors 124 to the electronic displacement control pump 122**.

The system 118 includes a mode interface 134, a user interface 136 and a controller 138. The mode interface 134 is in operable communication with the controller 138 and is configured to receive a mode input (selection) from a user. The mode input (selection) may be speed mode or torque mode. If the mode input (selection) is speed mode, the mode interface 134 transmits that mode input to the controller 138 and the system 118 is then placed in speed mode by the controller 138. If the mode input (selection) is torque mode the mode interface 134 transmits that mode input to the controller 138 and the system 118 is then placed in torque mode by the controller 138.

The user interface 136 is in operable communication with the controller 138 and is configured to receive and transmit a user input to the controller 138. In an embodiment, the user interface 136 may be a joystick, lever, dial or the like. When the system 118 is in speed mode, the user input received from the user interface 136 is recognized by the controller 138 as representative of a requested swing motor speed, and when the system 118 is in torque mode, the user input received from the user interface 136 is recognized by the controller 138 as representative of the requested swing motor torque. Thus, the same user interface 136, for example a single joystick, may be utilized to control either the output speed or the torque of the swing motor(s) 124 depending on the mode selected on the mode interface 134 by an operator/user. In some embodiments, the mode interface 134 and the user interface 136 may be part of the same device, in other embodiments the mode interface 134 and the user interface 136 may be separate/different devices.

The controller 138 is in operable communication with the hydrostatic circuit 120 (for example, the electronic displacement control pump 122 of the hydrostatic circuit 120), the speed sensor 130 (if any), the pressure sensors 131 (if any). In some embodiments, the controller 138 may be in operable communication with the first and second swing motors 124*a*,124*b* and the charge pump 129. The controller 138 is configured to transmit a pump displacement signal (e.g., voltage, current) (based on or representative of a final pump displacement command) to the electronic displacement control pump 122 as a result of the user input received by the user interface 136 and transmitted to the controller 138.

The hydrostatic circuit 120 is configured to control the actual speed of the swing motors 124*a*, 124*b* when the user input is associated with a requested swing motor speed and is configured to control a torque of the swing motors 124*a*, 124*b* when the user input is associated with a requested swing motor torque.

The controller 138 may include a processor 140 and a memory component 142. The processor 140 may be a microprocessor or other processor as known in the art. The processor 140 may execute instructions and generate control signals for: processing a user input, mode input, actual speed (data), input pressure (data), output pressure (data), pump pressure adjustment(s); calculating measured differential pressure, speed error, pressure error, a damping value, a proportional integral differential (PID) pump displacement adjustments, an estimated pump displacement, an adjusted pump displacement command, a final pump displacement command and the like; and mapping various values to other values (via lookup tables, algorithms or the like). Such instructions that are capable of being executed by a computer may be read into or embodied on a computer readable medium, such as the memory component 142 or provided external to the processor 140. In alternative embodiments, hard wired circuitry may be used in place of, or in combination with, software instructions to implement a control method.

The term "computer readable medium" as used herein refers to any non-transitory medium or combination of media that participates in providing instructions to the processor 140 for execution. Such a medium may comprise all computer readable media except for a transitory, propagating signal. Forms of computer-readable media include, for example, any magnetic medium, a CD-ROM, any optical medium, or any other medium from which a computer processor 140 can read.

The controller 138 is not limited to one processor 140 and memory component 142. The controller 138 may be several processors 140 and memory components 142.

INDUSTRIAL APPLICABILITY

Figure 3:
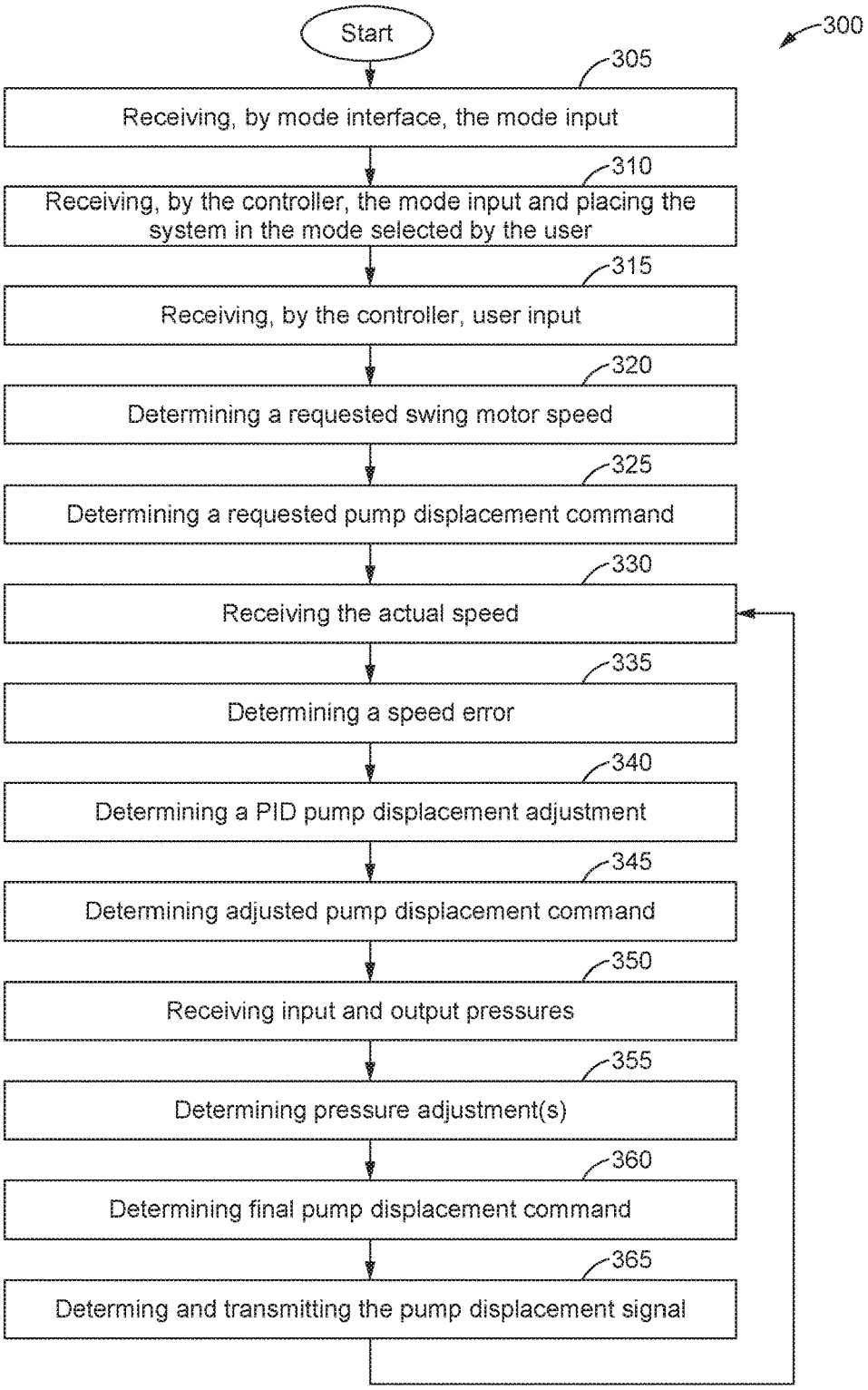
FIG. 3 is an exemplary process for controlling the rotational movement of an upper carriage 104 on the machine 100 of FIG. 1 when the system 118 of FIG. 2 is in speed mode.

FIG. 3 illustrates an exemplary process 300 for controlling the rotational (swing) movement of the upper carriage 104 of the machine 100, relative to the lower carriage 106, when the mode input selected by the operator/user on the mode interface 134 (and transmitted to the controller 138) is the speed mode.

In block 305, the mode interface 134 receives the mode input selection. The selection is then transmitted to the controller 138.

In block 310, the controller 138 receives, from the mode interface 134, the mode input selected by the user. In the embodiment of FIG. 3, the mode input selected by the user/operator and received by the controller 138 is the speed mode. The controller 138 places the system 118 in speed mode based on the mode input received.

In block 315, the controller 138 receives the user input from the user interface 136.

In block 320, the controller 138 determines a requested swing motor speed based on the user input. A requested swing motor speed is determined (as opposed to a requested swing motor torque) because the system 118 is in speed mode. In one embodiment, the controller 138 may map user input in the form of a displacement of the user interface 136 (e.g., joystick, lever or dial) to the requested swing motor speed.

In block 325, the controller 138 determines as an (initial) requested pump displacement command (value), a "feed forward" term based on the requested swing motor speed (see block 320). In an embodiment, the controller 138 may determine the "feed forward" term based on a map of the requested swing motor speed to the (initial) requested pump displacement command (value).

In block 330, the controller 138 receives from the speed sensor 130 an actual speed for at least one of the swing motors 124, for example the first swing motor 124*a*.

In block 335, the controller 138 determines a speed error. The speed error is the requested swing motor speed less the actual speed.

In block 340, the controller 138 determines a proportional integral differential (PID) pump displacement adjustment (value) based on the speed error (see block 335). The PID pump displacement adjustment (value) is a feedback value used to adjust the feed forward (initial) requested pump displacement command (value) to drive the swing motor speed more closely to the desired speed and to damp oscillations. In some embodiments, the derivative contribution of the PID pump displacement adjustment may only be utilized to damp oscillations if the speed error is less than a speed error threshold, e.g. 500 rpm, by setting the derivative gain to zero when the error is large. Such a scheme retains the damping benefits of the derivative term when stopping or otherwise nearing the desired swing motor speed without the slower acceleration derivative control causes when the error is large. The PID pump displacement adjustment value based on the speed error is the sum of a proportional gain multiplied by the speed error, an integral gain proportional to the integral of the speed error, and a derivative gain multiplied by the derivative of the speed error.

In block 345, the controller 138 determines an adjusted pump displacement command (value). The adjusted pump displacement command (value) is the sum of the feed forward term (requested pump displacement command; see block 325) and the PID pump displacement adjustment value of block 340 ("motor speed control adjustment" from the PID feedback).

In block 350, the controller 138 receives, from a first pressure sensor 131, the input pressure of the fluid received by the first swing motor 124*a*. The controller 138 also receives, from a second pressure sensor 131, the output pressure of the fluid that has been discharged by the swing motor(s) 124 and is returning to the electronic displacement control pump 122.

In block 355, the controller 138 may determine one or more pump pressure adjustments. More specifically, the controller 138 may calculate a pressure-limiting pump displacement adjustment and/or a pressure rise rate reducing pump displacement adjustment.

The controller 138 may calculate the pressure-limiting pump displacement adjustment to further adjust the adjusted pump displacement command (value of block 345), if necessary, to limit pressure on the ports of the swing motor 124 to some maximum limit, for example 350 bar. The controller 138 monitors the pressure on each port (input and output ports), and if the fluid pressure at either exceeds the desired maximum limit value (e.g., 350 bar), the error between the pressure feedback and the desired maximum limit value is calculated. The pressure-limiting pump displacement adjustment is calculated using proportional control (a proportional gain multiplied by the error (the differential pressure above the desired maximum limit value for the pressure)) to reduce the pressure on the swing motor 124 ports towards the desired pressure maximum limit.

As described above, the method seeks to limit the fluid pressure to a desired maximum limit value (e.g., 350 bar) using proportional control. However, if the fluid pressure is rising quickly, when it reaches the desired maximum limit value (e.g., 350 bar) the pressure may spike well above such desired maximum limit value (e.g., 350 bar) before the proportional control can effectively cause the electronic displacement control pump 122 to stroke back. Thus, to limit pressure overshoot of the desired maximum limit value (e.g., 350 bar), a derivative control (the pressure rise rate reducing pump displacement adjustment) may be employed to slow the pressure rise rate before the fluid pressure reaches the desired pressure maximum limit. If a swing motor 124 port pressure has exceeded a threshold value, for example 250 bar, and the pressure is rising, the controller 138 calculates the pressure rise rate reducing pump displacement adjustment that is proportional to the pressure rise rate. This pressure rise rate reducing pump displacement adjustment will reduce the pressure rise rate as the desired maximum limit value (e.g., 350 bar) for the pressure is approached without reducing system response when the fluid pressure is below the threshold (250 bar).

In block 360, the controller 138 determines the final pump displacement command (value). The final pump displacement command (value) is the adjusted pump displacement command (value) reduced by the pump pressure adjustment (s) (the pressure-limiting pump displacement adjustment (if any) and/or the pressure rise rate reducing pump displacement adjustment (if any)). If there is no pressure-limiting pump displacement adjustment or pressure rise rate reducing pump displacement adjustment, then the final pump displacement command (value) is the same as the adjusted pump displacement command (value). The final pump displacement command (value) is based on the sum of a number of terms, a feed forward term (the (initial) requested pump displacement command value), a PID pump displacement adjustment value (a swing motor speed feedback term to improve tracking of the desired speed and reduce oscillations in the swing motor speed), a pressure-limiting pump displacement adjustment term (if any) to prevent the electronic displacement control pump 122 from exceeding a pressure threshold, and a pressure rise rate reducing pump displacement adjustment term (if any) to limit pressure limit overshoot by reducing the rise rate as the pressure limit is approached.

In block 365, the controller 138 determines the pump displacement signal. In one embodiment, the controller 138 maps the final pump displacement command (value) of block 360 to the pump displacement signal (e.g., current or voltage) that controls the fluid displacement volume of the electronic displacement control pump 122. The controller 138 then transmits the resulting pump displacement signal to the electronic displacement control pump 122.

Figure 4:
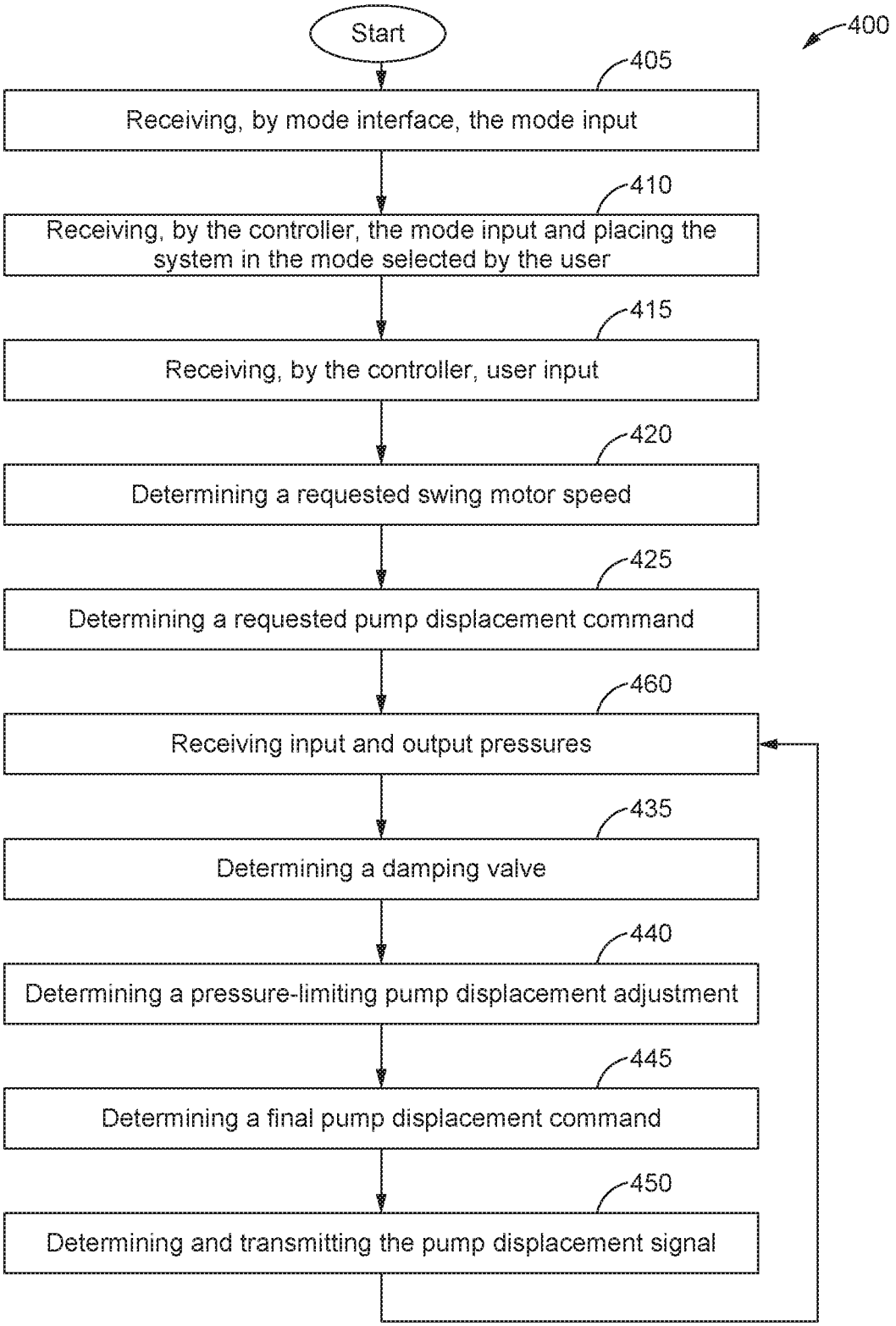
FIG. 4 is an alternative exemplary process for controlling the rotational movement of an upper carriage 104 on the machine 100 of FIG. 1 when the system 118 of FIG. 2 is in speed mode.

FIG. 4 illustrates an exemplary process 400 for controlling rotational (swing) movement of the upper carriage 104 of the machine 100 when the mode input is speed mode and (1) the system 118 does not include the speed sensor 130 or (2) data from the speed sensor 130, for example the actual speed of the first swing motor 124*a*, is not being received by the controller 138. The method of FIG. 4 is similar to that of FIG. 3, however, instead of taking the derivative of the motor speed feedback (see block 340 of FIG. 3), the method of FIG. 4 uses the differential pressure (see block 435) to obtain a value similar to a motor speed derivative. In addition, unlike the method of FIG. 3 which determines a PID, the method of FIG. 4 does not determine a proportional integral value with regard to the motor speed control.

In block 405, the mode interface 134 receives the mode input selection. The selection is then transmitted to the controller 138.

In block 410, the controller 138 receives, from the mode interface 134, the mode input selected by the user. In the method of FIG. 4, the mode input selected by the user/operator and received by the controller 138 is the speed mode. The controller 138 places the system 118 in speed mode based on the mode input received.

In block 415, the controller 138 receives the user input from the user interface 136.

In bock 420, the controller 138 determines a requested swing motor speed based on the user input. In one embodiment, the controller 138 may map user input in the form of a displacement of the user interface 136 (e.g., joystick, lever or dial) to the requested swing motor speed.

In block 425, the controller 138 determines an (initial) requested pump displacement command (value), a feed forward term based on the requested swing motor speed (see block 420). In one embodiment, the controller 138 may determine such feed forward term by mapping the requested swing motor speed of block 420 to the (initial) requested pump displacement command (value).

In block 430, the controller 138 receives, from a first pressure sensor 131, the input pressure of the fluid received by the first swing motor 124*a*. The controller 138 also receives, from a second pressure sensor 131, the output pressure of the fluid that has been discharged by the swing motor(s) 124 and is returning to the electronic displacement control pump 122.

In block 435, the controller 138 determines a damping value. The damping value of the method of FIG. 4 is a swing motor 124 feedback term that is proportional to the differential pressure between the input pressure and the output pressure. Since such differential pressure is proportional to the swing motor acceleration, or the derivative of the swing motor speed, the damping effect of a swing motor speed derivative term is implemented in the method of FIG. 4 (see block 445 below), by adjusting the (initial) requested pump displacement command (value) by a term (the damping value) that is proportional to differential pressure across the swing motor 124. This reduces undesirable oscillations of the swing motor speed by reducing the requested pump displacement command (value) proportional to the differential pressure.

In block 440, the controller 138 determines a pressure-limiting pump displacement adjustment to limit pressure on the ports of the swing motor 124 to some maximum limit, for example 350 bar. The controller 138 monitors the pressure on each port (input and output ports), and if the fluid pressure at either exceeds the desired maximum limit value (e.g., 350 bar), the error between the pressure feedback and the desired maximum limit value is calculated. The pressure-limiting pump displacement adjustment is calculated via a proportional gain multiplied by the error to reduce the pressure on the swing motor 124 ports towards the desired pressure maximum limit.

In block 445, the controller 138 determines the final pump displacement command (value) for the electronic displacement control pump 122. The controller 138 then maps the final pump displacement command value to a pump displacement signal (e.g., current or voltage) that controls the fluid displacement volume of the electronic displacement control pump 122.

The final pump displacement command (value) (and the pump displacement signal) is based on a feed forward term (the requested pump displacement command value) as adjusted by (1) swing motor feedback based on the calculated differential pressure (see damping value of block 435) and (2) the pressure-limiting pump displacement adjustment (if any). More specifically, in one embodiment, the final pump displacement command (value) may be calculated as the requested pump displacement command value as reduced by (1) the damping value and (2) the pressure-limiting pump displacement adjustment (if any).

In block 450, the controller 138 determines the pump displacement signal. In one embodiment, the controller 138 maps the final pump displacement command (value) of block 445 to the pump displacement signal (e.g., current or voltage) that controls the fluid displacement volume of the electronic displacement control pump 122. The controller 138 then transmits the resulting pump displacement signal to the electronic displacement control pump 122.

Figure 5:
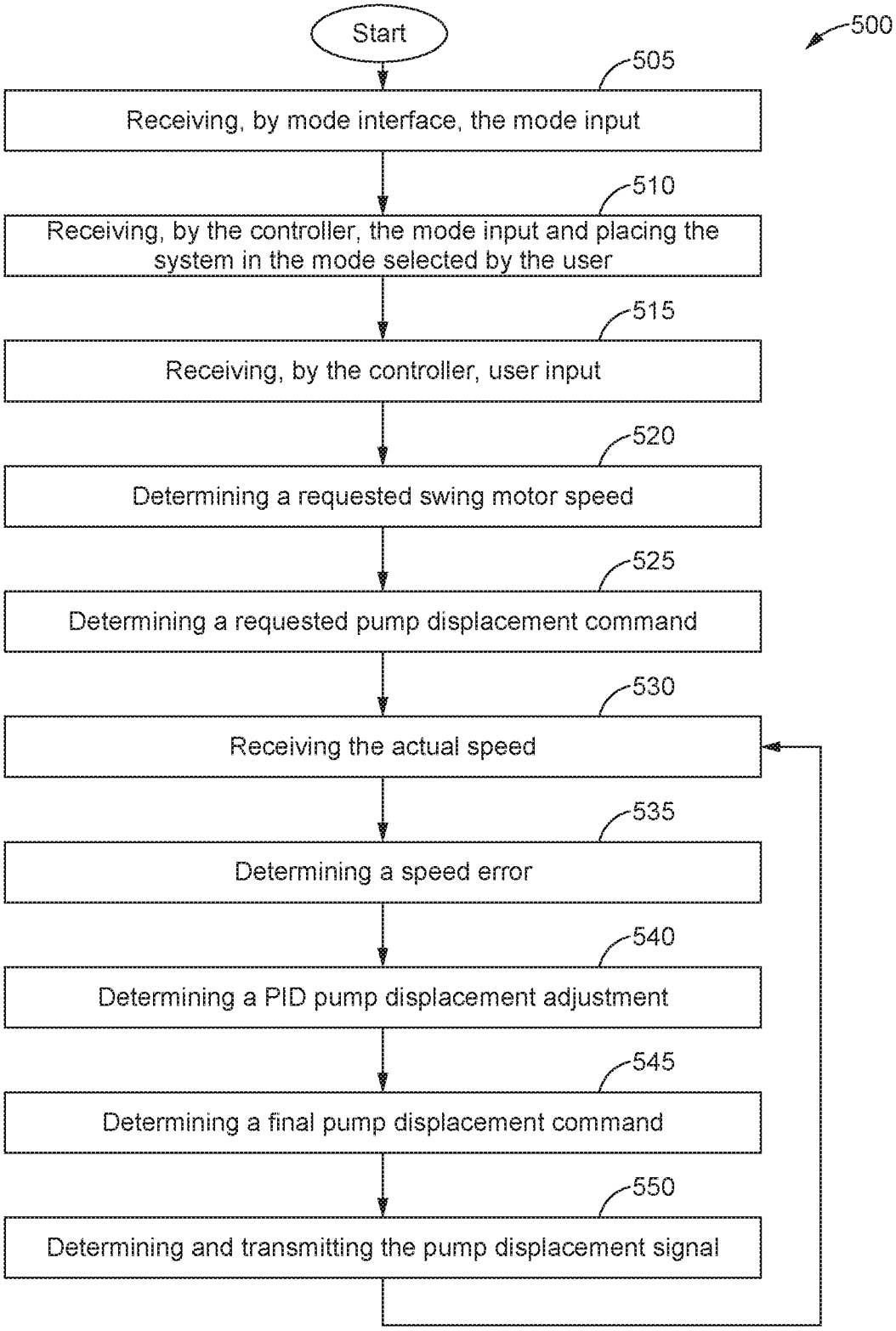
FIG. 5 is an alternative exemplary process for controlling the rotational movement of an upper carriage 104 on the machine 100 of FIG. 1 when the system 118 of FIG. 2 is in speed mode.

FIG. 5 illustrates an exemplary process 500 for controlling rotational (swing) movement of the upper carriage 104 of the machine 100 when the mode input is speed mode and the system 118 does not include pressure sensors 131 or pressure sensor feedback is not being received by the controller 138.

In block 505, the mode interface 134 receives the mode input selection. The selection is then transmitted to the controller 138.

In block 510, the controller 138 receives, from the mode interface 134, the mode input selected by the user. In the method of FIG. 5, the mode input selected by the user/operator and received by the controller 138 is the speed mode. The controller 138 places the system 118 in speed mode based on the mode input received.

In block 515, the controller 138 receives the user input from the user interface 136.

In block 520, the controller 138 determines a requested swing motor speed based on the user input. In one embodiment, the controller 138 may map user input in the form of a displacement of the user interface 136 (e.g., joystick, lever or dial) to the requested swing motor speed.

In block 525, the controller 138 determines as an (initial) requested pump displacement command (value), a feed forward term based on the requested swing motor speed (see block 520). In an embodiment, the controller 138 may determine the feed forward term based on a map of the requested swing motor speed to the (initial) requested pump displacement command (value).

In block 530, the controller 138 receives from the speed sensor 130 an actual speed for at least one of the swing motors 124, for example the first swing motor 124*a*.

In block 535, the controller 138 determines a speed error. The speed error is the requested swing motor speed less the actual speed.

In block 540, the controller 138 determines a PID pump displacement adjustment (value) based on the speed error (see block 535). The PID pump displacement adjustment (value) is a feedback value used to adjust the feed forward (initial) requested pump displacement command (value) to drive the swing motor speed more closely to the desired speed and to damp oscillations. In some embodiments, the derivative contribution of the PID pump displacement adjustment may only be utilized to damp oscillations if the speed error is less than a speed error threshold, e.g. 500 rpm, by setting the derivative gain to zero when the error is large. Such a scheme retains the damping benefits of the derivative term when stopping or otherwise nearing the desired swing motor speed without the slower acceleration derivative control causes when the error is large. The PID pump displacement adjustment value based on the speed error is the sum of a proportional gain multiplied by the speed error, an integral gain proportional to the integral of the speed error, and a derivative gain multiplied by the derivative of the speed error.

In block 545, the controller 138 determines a final pump displacement command (value) for the electronic displacement control pump 122. The final pump displacement command (value) is the sum of the feed forward term (initial requested pump displacement command; see block 525) and the PID pump displacement adjustment value of block 540 ("motor speed control adjustment" from the PID feedback).

In block 550, the controller 138 determines the pump displacement signal. In one embodiment, the controller 138 maps the final pump displacement command (value) of block 545 to the pump displacement signal (e.g., current or voltage) that controls the fluid displacement volume of the electronic displacement control pump 122. The controller 138 then transmits the resulting pump displacement signal to the electronic displacement control pump 122.

Figure 6:
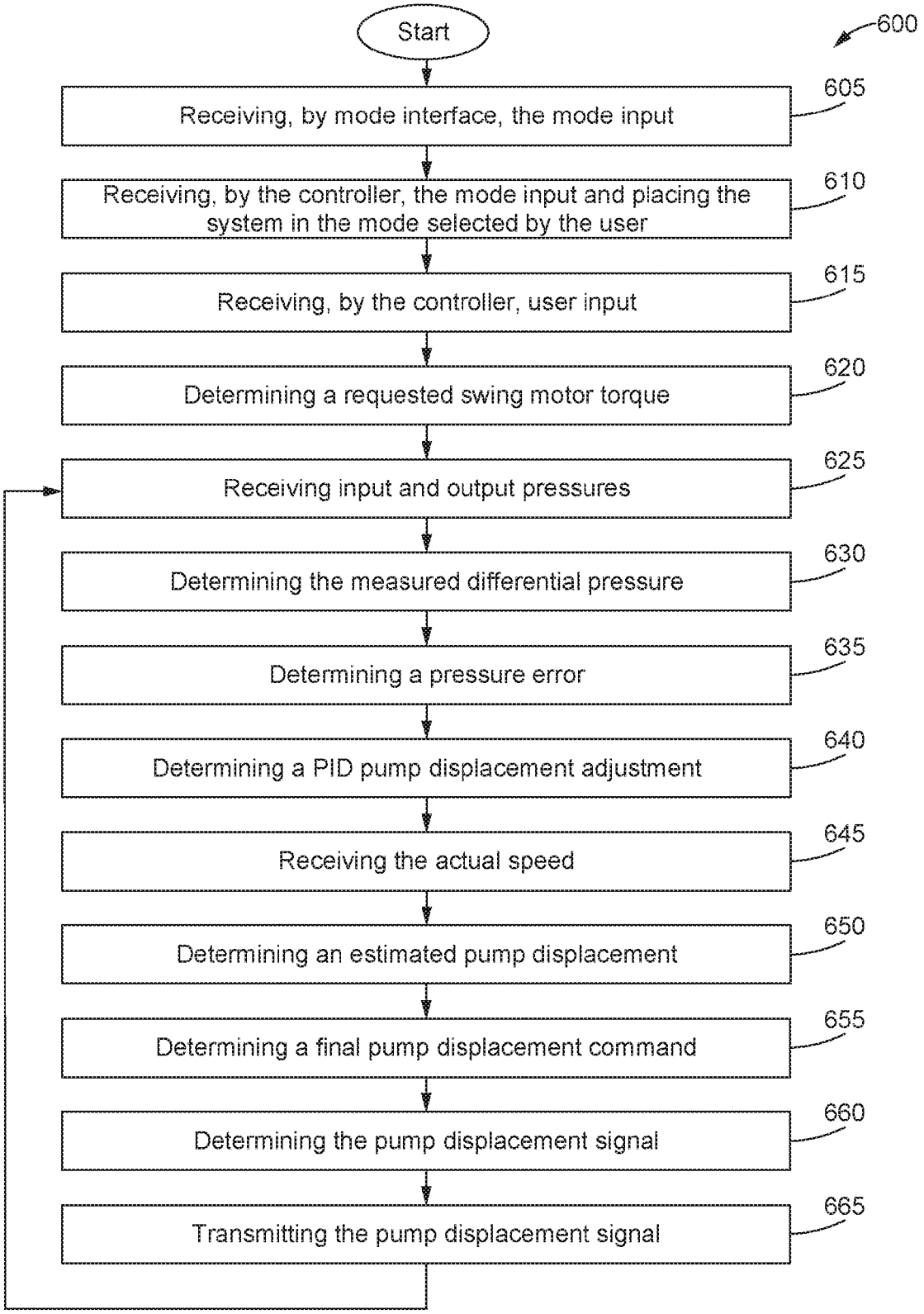
FIG. 6 is an exemplary process for controlling the rotational movement of an upper carriage 104 on the machine 100 of FIG. 1 when the system 118 of FIG. 2 is in torque mode.

FIG. 6 illustrates an exemplary process 600 for controlling rotational (swing) movement of the upper carriage 104 of the machine 100 when the mode input is torque mode.

In block 605, the mode interface 134 receives the mode input selection. The selection is then transmitted to the controller 138.

In block 610, the controller 138 receives from the mode interface 134 the mode input selected by the user. In the embodiment of FIG. 6, the mode input selected by the user/operator and received by the controller 138 is the torque mode. The controller 138 places the system 118 in torque mode based on the mode input received.

In block 615, the controller 138 receives the user input from the user interface 136.

In block 620, the controller 138 determines a requested swing motor torque based on the user input. In one embodiment, the controller 138 may map user input in the form of a displacement of the user interface 136 (e.g., joystick, lever or dial) to a requested swing motor torque from which a differential pressure, "the requested differential pressure," is derived by the controller 138, or, alternatively, the controller 138 may map the user input directly to the requested differential pressure for the swing motor 124.

In block 625, the controller 138 receives, from a first pressure sensor 131, the input pressure of the fluid received by the first swing motor 124*a*. The controller 138 also receives, from a second pressure sensor 131, the output pressure of the fluid that has been discharged by the swing motor(s) 124 and is returning to the electronic displacement control pump 122.

In block 630, the controller 138 determines the (measured) differential pressure across one of the swing motors 124. The measured differential pressure, in this embodiment, is the difference between the input pressure and the output pressure.

In block 635, the controller 138 determines the pressure error. The pressure error is the difference between the requested differential pressure (block 620) and the measured differential pressure (block 630).

In block 640, the controller 138 determines the proportional integral differential (PID) pump displacement adjustment based on the pressure error as the sum of a proportional gain multiplied by the pressure error, an integral gain proportional to the integral of the pressure error, and a derivative gain multiplied by the derivative of the pressure error.

In block 645 the controller 138 receives the actual speed of the swing motor(s) 124 from the speed sensor 130.

In block 650, the controller 138 determines an estimated pump displacement based on the actual speed of the swing motor 124. In one embodiment, the controller 138 may determine the estimated pump displacement by mapping the actual speed of the swing motor 124 to the estimated pump displacement.

In block 655, the controller 138 determines a final pump displacement command (value). The final pump displacement command is the sum of a feed forward term (the estimated pump displacement based on the measured swing motor speed) and a pressure feedback term (the PID pump displacement adjustment). More specifically, the final pump displacement command is the sum of the estimated pump displacement and the PID pump displacement adjustment.

In block 660, the controller 138 determines a pump displacement signal based on the final pump displacement command. In one embodiment, the controller 138 determines the pump displacement signal by mapping the final pump displacement command determined in block 655 to the pump displacement signal.

In block 665, the controller 138 transmits the pump displacement signal to the electronic displacement control pump 122.

Figure 7:
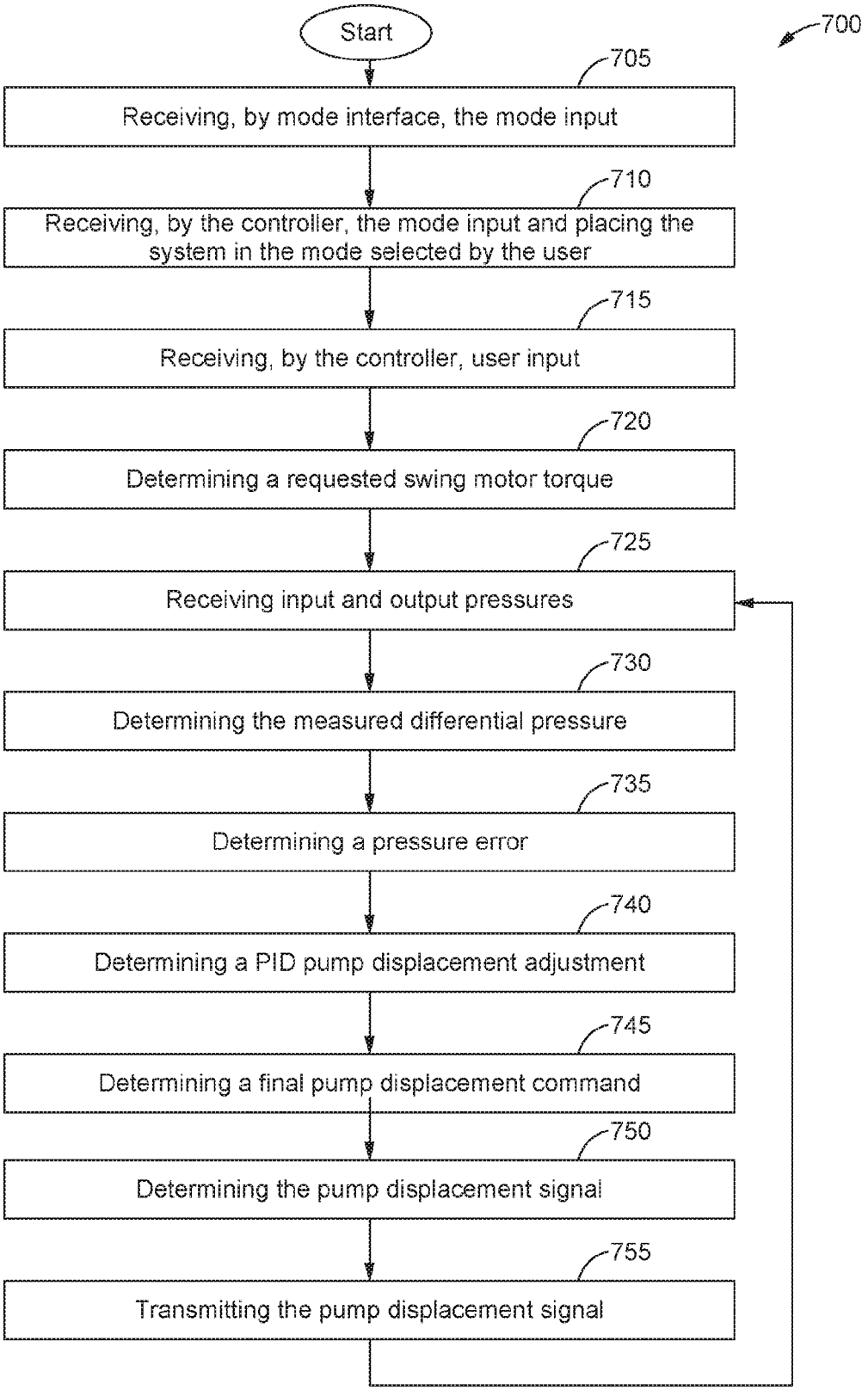
FIG. 7 is an alternative exemplary process for controlling the rotational movement of an upper carriage 104 on the machine 100 of FIG. 1 when the system 118 of FIG. 2 is in torque mode.

FIG. 7 illustrates an exemplary process 700 for controlling rotational (swing) movement of the upper carriage 104 of the machine 100 when the mode input is torque mode and the system 118 does not include a speed sensor 130 or speed sensor feedback is not being received (for example, when a speed sensor 130 is damaged or not functioning).

In block 705, the mode interface 134 receives the mode input selection. The selection is then transmitted to the controller 138.

In block 710, the controller 138 receives from the mode interface 134 the mode input selected by the user. In the method of FIG. 7, the mode input selected by the user/operator and received by the controller 138 is the torque mode. The controller 138 places the system 118 in torque mode based on the mode input received.

In block 715, the controller 138 receives the user input from the user interface 136.

In block 720, the controller 138 determines a requested swing motor torque (differential pressure) based on the user input. In one embodiment, the controller 138 may map user input in the form of a displacement of the user interface 136 (e.g., joystick, lever or dial) to a requested swing motor torque from which a differential pressure, "the requested differential pressure," is derived by the controller 138, or, alternatively, the controller 138 may map the user input directly to the requested differential pressure for the swing motor 124.

In block 725, the controller 138 receives, from a first pressure sensor 131, the input pressure of the fluid received by the first swing motor 124*a*. The controller 138 also receives, from a second pressure sensor 131, the output pressure of the fluid that has been discharged by the swing motor(s) 124 and is returning to the electronic displacement control pump 122.

In block 730, the controller 138 determines the (measured) differential pressure. The measured differential pressure, in this embodiment, is the difference between the input pressure and the output pressure.

In block 735, the controller 138 determines the pressure error. The pressure error is the difference between the requested differential pressure (block 720) and the measured differential pressure (block 730).

In block 740, the controller 138 determines the proportional integral differential (PID) pump displacement adjustment based on the pressure error as the sum of a proportional gain multiplied by the pressure error, an integral gain proportional to the integral of the pressure error, and a derivative gain multiplied by the derivative of the pressure error.

In block 745, the controller 138 determines final pump displacement command (value) based on the PID pump displacement adjustment (block 740). In one embodiment, the final pump displacement command (value) is the same as the PID pump displacement adjustment.

In block 750, the controller 138 determines a pump displacement signal. In one embodiment, the controller 138 determines the pump displacement signal by mapping the final pump displacement command to the pump displacement signal.

In block 755, the controller 138 transmits the pump displacement signal to the electronic displacement control pump 122.

Also disclosed is a method of controlling the swing of an upper carriage 104 of a machine 100. The method may comprise receiving a mode input; placing, by the controller 138, the system 118 in a speed mode or a torque mode based on the mode input; receiving, by the controller 138, a user input, the user input received as a requested swing motor speed if the system 118 is in speed mode or received as a requested swing motor torque if the system 118 is in torque mode; and controlling, by the system 118, the swing of the upper carriage 104 based on the mode input and the user input. In an embodiment, the method may further include, if the system 118 is in speed mode, determining a final pump displacement command, and transmitting a pump displacement signal (based on the final pump displacement command) to the electronic displacement control pump 122, wherein the final pump displacement command is based, at least in part, on a PID pump displacement adjustment that is based on speed error. The final pump displacement command may be further based on the requested swing motor speed.

In an embodiment, the method may include, if the system 118 is in speed mode, determining a final pump displacement command, wherein the final pump displacement command is based on the requested swing motor speed and damping value that is proportional to a differential pressure across the first swing motor 124*a*.

In an embodiment, the method may include, if the system 118 is in torque mode, determining a final pump displacement command and transmitting a pump displacement signal (representative of the final pump displacement command) to the electronic displacement control pump 122, wherein the final pump displacement command is based at least in part on PID pump displacement adjustment that is based on pressure error. In a refinement the final pump displacement command may be further based on an estimated pump displacement that is based on an actual speed of the swing motor 124.

The features disclosed herein may be particularly beneficial to machines 100 such as excavators and hydraulic mining shovels 102. The system 118 disclosed herein provides hydraulic swing control that allows operation in either speed or torque control modes. The same hardware configuration can be used to implement swing speed control or swing torque control, and such operating characteristics can be changed during use of the system 118 without the need for a change to the system hardware configuration. Advantages of such includes the ability to accommodate various operator preferences as well as various sizes, types and operations of machines. Furthermore, the teachings of this disclosure may be employed to reduce bounce/oscillation in the hydrostatic circuit 120 that controls such rotation or swing.

What is claimed is:

1. A system for controlling swing of an upper carriage of a machine, the system comprising:

a hydrostatic circuit that includes:

an electronic displacement control pump, configured to control a supply of a fluid to a first hydraulic swing motor based on a final pump displacement command;

a second hydraulic swing motor fluidly connected to the electronic displacement control pump by the first conduit, the first swing motor and the second swing motor connected in parallel, the second swing motor configured to rotate the upper carriage of the machine, the first hydraulic swing motor fluidly connected to the electronic displacement control pump, the first hydraulic swing motor configured to rotate the upper carriage of the machine;

a first conduit fluidly connecting the electronic displacement control pump and the first hydraulic swing motor; and a second conduit fluidly connecting the electronic displacement control pump and the first hydraulic swing motor;

a speed sensor configured to measure an actual speed of the first hydraulic swing motor;

a first pressure sensor configured to measure an input pressure of the fluid received by the first hydraulic swing motor;

a second pressure sensor configured to measure an output pressure of the fluid discharged from the first hydraulic swing motor;

a user interface in operable communication with a controller and configured to receive and transmit a user input to the controller; and the controller in operable communication with the hydrostatic circuit, the controller configured to transmit a pump displacement signal representative of the final pump displacement command to the electronic displacement control pump as a result of the user input, wherein, the hydrostatic circuit is a closed loop circuit that is configured to control the actual speed of the first hydraulic swing motor when the user input is associated with a requested swing motor speed and is configured to control a torque of the first hydraulic swing motor when the user input is associated with a requested swing motor torque.

2. The system of claim 1, wherein, when the user input is associated with the requested swing motor speed, the final pump displacement command is based on the requested swing motor speed, and a first PID pump displacement adjustment that is based on speed error, wherein further, when the user input is associated with the requested swing motor torque, the final pump displacement command is based at least in part on a second PID pump displacement adjustment that is based on pressure error.

3. The system of claim 2, wherein, when the user input is associated with the requested swing motor speed, the final pump displacement command is based on the requested swing motor speed, the first PID pump displacement adjustment that is based on speed error, and a pump pressure adjustment.

4. The system of claim 3, wherein the pump pressure adjustment includes a pressure-limiting pump displacement adjustment and a pressure rise rate reducing pump displacement adjustment.

5. The system of claim 3, wherein, when the user input is associated with the requested swing motor speed, the final pump displacement command is based on the requested swing motor speed, and a damping value that is proportional to a differential pressure across the first swing motor.

6. The system of claim 1, wherein the user interface is a joystick, lever or dial.

7. The system of claim 6, further including a mode interface in operable communication with the controller, the mode interface configured to receive mode input from a user that places the system in either speed mode or torque mode, wherein, when the system is in speed mode, the user input transmitted from the user interface is recognized by the controller as associated with the requested swing motor speed and when the system is in torque mode, the user input is recognized as associated with the requested swing motor torque.

8. A method of controlling swing of an upper carriage of a machine, the machine including the upper carriage, a lower carriage and a system, the upper carriage rotationally connected to the lower carriage, the lower carriage including ground engaging elements, the system including a controller and a hydrostatic circuit, the hydrostatic circuit including an electronic displacement control pump, a first hydraulic swing motor fluidly connected to the electronic displacement control pump, and a mode interface, the method comprising:

receiving a mode input via the mode interface;

placing, by the controller, the system in a speed mode or a torque mode based on the mode input, the system operable in the speed mode when the mode input is speed mode and operable in the torque mode when the mode input is torque mode;

receiving, by the controller, a user input, the user input received as a requested swing motor speed if the system is in speed mode or received as a requested swing motor torque if the system is in torque mode; and controlling, by the system, the swing of the upper carriage based on the mode input and the user input, wherein the hydrostatic circuit is a closed loop circuit.

9. The method of claim 8, further including:

if the system is in speed mode, determining a final pump displacement command; and transmitting a pump displacement signal based on the final pump displacement command to the electronic displacement control pump, wherein the final pump displacement command is based, at least in part, on a PID pump displacement adjustment that is based on speed error.

10. The method of claim 9, wherein the pump displacement command is further based on the requested swing motor speed.

11. The method of claim 8 further including:

if the system is in speed mode, determining a final pump displacement command, wherein the final pump displacement command is based on the requested swing motor speed and a damping value that is proportional to a differential pressure across the first swing motor.

12. The method of claim 8, wherein the machine is an excavator or a hydraulic swing shovel.

13. The method of claim 8, further including:

if the system is in torque mode, determining a final pump displacement command; and transmitting a pump displacement signal representative of the final pump displacement command to the electronic displacement control pump, wherein the final pump displacement command is based at least in part on PID pump displacement adjustment that is based on pressure error.

14. The method of claim 13, wherein the final pump displacement command is based at least in part on an estimated pump displacement and the PID pump displacement adjustment, wherein in the estimated pump displacement is based on an actual speed of the swing motor, and the PID pump displacement adjustment is based on pressure error.

15. A system for controlling rotational swing of an upper carriage of a machine, the system comprising:

a hydrostatic circuit that includes:

an electronic displacement control pump configured to receive a pump displacement signal that controls a fluid displacement volume of the electronic displacement control pump, the pump displacement signal representative of a final pump displacement command;

a first swing motor fluidly connected to the electronic displacement control pump, the first swing motor configured to rotate the upper carriage of the machine, wherein, the hydrostatic circuit is a closed loop circuit that is configured to control (a) an actual speed of the first swing motor when a final pump displacement command results from a requested swing motor speed and (b) a torque of the first swing motor when the final pump displacement command results from a requested swing motor torque;

a first pressure sensor configured to measure an input pressure of fluid received by the first swing motor; and a second pressure sensor configured to measure an output pressure of fluid discharged from the first swing motor, wherein, the final pump displacement command results from the requested swing motor speed and a damping value that is proportional to a differential pressure across the first swing motor.

16. The system of claim 15 further including a speed sensor configured to measure the actual speed of the first swing motor.

17. The system of claim 16, wherein, when the final pump displacement command results from a requested swing motor speed, the pump displacement command is based at least on a PID pump displacement adjustment that is based on speed error.

18. The system of claim 15 further including:

a first pressure sensor configured to measure an input pressure of fluid received by the first swing motor; and a second pressure sensor configured to measure an output pressure of fluid discharged from the first swing motor, wherein, when the final pump displacement command results from a requested swing motor torque, the final pump displacement command is based at least in part on a PID pump displacement adjustment that is based on pressure error.

* * * * *